US005795131A

United States Patent [19]

Crowhurst et al.

[11] Patent Number: 5,795,131

[45] Date of Patent: Aug. 18, 1998

[54] FAN AIR CLEANER

[75] Inventors: Paul E. Crowhurst, Beaconsfield; David Lekhtman, Morin Heights, both of Canada

[73] Assignee: ClairIon Inc., Beaconfield, Canada

[21] Appl. No.: 652,388

[22] Filed: May 23, 1996

[51] Int. Cl.[6] ..... F04D 29/70

[52] U.S. Cl. ..... 416/146 R; 416/5; 416/62; 416/91; 55/471; 55/DIG. 39; 95/78; 95/277; 96/63; 96/97; 422/121; 422/124

[58] Field of Search ..... 416/5, 62, 91, 416/146 R; 55/467, DIG. 39, 471; 95/57, 78, 277; 96/63, 97, 60–62; 422/4, 5, 22, 121, 122, 124

[56] References Cited

U.S. PATENT DOCUMENTS

| | | | |
|---|---|---|---|
| D. 306,198 | 2/1990 | Matherne . | |
| D. 308,721 | 6/1990 | Ahl . | |
| 2,409,579 | 10/1946 | Meston | 96/97 |
| 3,422,263 | 1/1969 | Asahina | 416/146 R |
| 4,422,824 | 12/1983 | Eisenhardt, Jr. | 416/5 |
| 4,504,191 | 3/1985 | Brown . | |
| 4,596,585 | 6/1986 | Moeller et al. | 95/57 |
| 4,676,721 | 6/1987 | Hardee . | |
| 4,750,863 | 6/1988 | Scoggins . | |
| 4,753,573 | 6/1988 | McKnight . | |
| 4,782,213 | 11/1988 | Teal | 416/5 |
| 4,832,572 | 5/1989 | Prucha et al. . | |
| 4,840,650 | 6/1989 | Matherne . | |
| 4,886,527 | 12/1989 | Föttinger et al. | 95/78 |
| 4,889,543 | 12/1989 | Burt . | |
| 5,341,565 | 8/1994 | Kuryliw | 416/5 |
| 5,370,721 | 12/1994 | Carnahan . | |
| 5,601,409 | 2/1997 | Huang | 416/5 |

*Primary Examiner*—Christopher Verdier

*Attorney, Agent, or Firm*—Michael A. Gollin; Spencer & Frank

[57] ABSTRACT

A ceiling fan for cleaning air in a room wherein each blade of the ceiling fan has a cavity open to the top and bottom surfaces of each fan blade and a filter unit in each of the cavities but within the confines of the fan blade such that, when the ceiling fan is operated, the airflow created by the ceiling fan will be forced through the filter unit from the bottom surface through to the top surface, wherein the filter units can collect airborne particles.

18 Claims, 3 Drawing Sheets

5
6
18
28
30
32
36
38
40
42
46
48
50
52
54
56
58
60
61
62

FAN AIR CLEANER

BACKGROUND OF THE INVENTION

1. Field of the Invention

The present invention relates to a room air cleaner, and more particularly, to a fan air cleaning device including a fan blade mounted air filter.

2. Description of the Prior Art

There are many different air cleaning systems utilizing a ceiling fan as a vehicle for carrying or mounting different air filters. These ceiling fan filters usually consist of attaching some type of air filter material to the blade or blades of the fan so that the filter is moved through the air as the ceiling fan is rotated. The filter collects debris and particles from the air as it moves through the air.

For instance, U.S. Pat. No. 4,753,573, issued Jun. 28, 1988 to Charles A. McKnight; U.S. Pat. No. 4,840,650, issued Jun. 20, 1989 to Elmer L. Matherne; and U.S. Pat. No. 5,370,721, issued Dec. 6, 1994 to Joe B. Carnahan; all describe filters that may be added to conventional ceiling fan blades. In this type of arrangement, the filter has a frontal attack plane that is perpendicular to the plane of rotation of the ceiling fan. In other words, the blades of the ceiling fan are effective to create an air circulation that is also perpendicular to the plane of rotation of the ceiling fan so that the airflow is parallel to the frontal attack plane of the filters. The filters "slice" through the airflow created by the ceiling fan and indirectly pass through some of the air, thus filtering the air that comes into contact with the individual filters mounted on the blades. Furthermore, a ceiling fan is a delicately balanced, yet inexpensive appliance. Any slight imbalance will cause vibrations in the fan, thus increasing the noise level and oscillating movement of the fan, thereby reducing the acceptability thereof.

U.S. Pat. No. 4,422,824, issued Dec. 27, 1983 to Charles A. Eisenhardt, Jr., describes an air filter that is integrated into a hollow fan blade at the leading and trailing edges thereof. An ultraviolet light source is provided in the hollow interior of the fan blade for the purpose of emitting radiation only through the leading and trailing edges of the blade so as to avoid plants, animals, and persons from being directly exposed to such rays. This patent is, therefore, similar to the above-mentioned patents since the frontal attack plane of the filters is at a right angle to the airflow, and thus the Eisenhardt, Jr. patent has similar disadvantages to the prior art mentioned above since the filters only indirectly meet part of the volume of airflow.

In many cases, the filter material has also been attached to the blade without any structural support. However, this has required the filter material to be rigid or flat so that the filter material would not deform or collapse from the pressure of the air as the air circulates over the fan. Blade covers made of dust-absorbent materials which fit substantially over the entire surface of the blade and are fastened in place have also been used.

Ceiling fans, such as described in U.S. Pat. No. 4,750,863, issued Jun. 14, 1988 to Glenn Scoggins, and U.S. Pat. No. 4,889,543, issued Dec. 26, 1989 to Jerry D. Burt, show filters that are provided parallel to the plane of rotation of the fan and thus perpendicular to the flow of air and, therefore, are much more effective than the above-mentioned prior art. However, these patents are somewhat unsightly and would not be acceptable in domestic environments because of this.

SUMMARY OF THE INVENTION

It is an aim of the present invention to provide a fan with filter means for cleaning air but without the disadvantages listed above.

It is a further aim of the present invention to provide a fan in which the filter components are incorporated in the fan blades but their frontal attack planes are substantially perpendicular to the flow of air created by the fan.

It is yet another aim of the present invention to provide a ceiling fan that incorporates an air cleaning device within the confines of the fan blade such that the fan may be designed as any conventional fan and the filters are not readily apparent or obtrusive.

It is a further aim of the present invention to provide for the use of a variety of high quality particulate and sorbent filters without regard for the structural properties of the filters.

It is a further aim of the present invention to incorporate a ceiling fan having both an ion emitter and an electrically charged filter in the fan blades such that an electrically charged field for charging particles is created to more readily capture the charged particles in the filters. Sorbent filters can also be added into the fan blade in combination with the electrically charged filters to adsorb gases and odors.

A construction in accordance with the present invention comprises a fan blade for a fan, the blade including a front surface and a parallel rear surface defined by a peripheral edge including side edge segments as well as a blade tip edge segment. The blade includes at least a cavity that is open to the front and rear surfaces and at least one filter unit is adapted to be seated in the cavity such that, as the fan is operated, the filter unit will be in a substantially perpendicular plane to the direction of the airflow created by the fan for more effectively filtering airborne particles from the airflow created by the fan.

In a more specific construction of the present invention, the fan is a ceiling fan, and the fan blade includes a frame defining the at least one cavity and a seat for receiving the at least one filter unit. More specifically, at least the front surface includes a bottom opening provided with a porous support structure to allow the filter unit to be structurally supported in the cavity.

In another aspect of the present invention, a fan is provided having a fixed frame, a motor mounted to the frame, a rotatable hub mounted to the motor, and a plurality of fan blades mounted for rotation on the hub and extending radially from the hub in a plane of rotation, the improvement comprising the combination of an ion emitter mounted to the frame and a plurality of electrically charged filter units mounted in cavities in at least some of the blades, wherein the blades having the cavities define openings in opposed surfaces of the blades coincident with the cavities so that airborne particles present in the airflow created by the fan, when in operation, may be more readily captured by the filter units in the blades.

In a more specific embodiment of the present invention, the blade frame defining the cavity is coincident with the side edges of the fan blade, and the cavity has a rectangular outline extending over a majority of the area of the blade.

BRIEF DESCRIPTION OF THE DRAWINGS

Having thus generally described the nature of the invention, reference will now be made to the accompanying drawings, showing by way of illustration, a preferred embodiment thereof, and in which.

DESCRIPTION OF THE PREFERRED EMBODIMENTS

Figure 1:
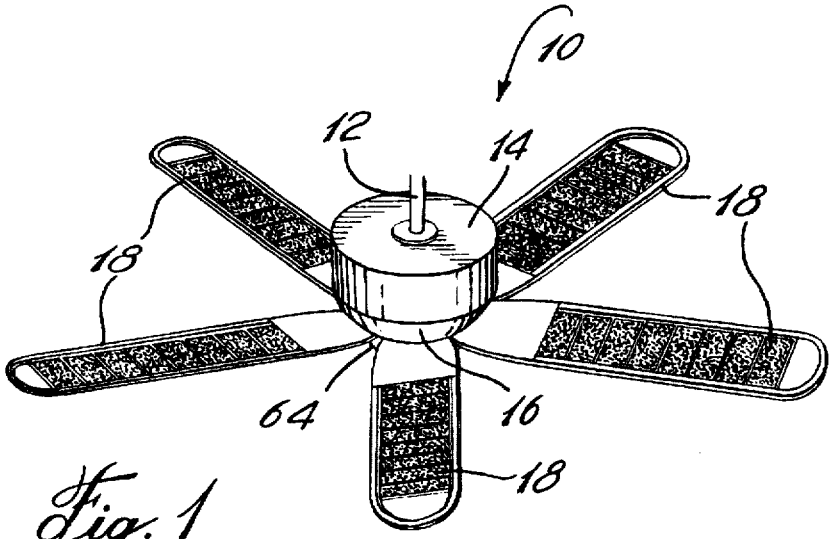
FIG. 1 is a perspective view of a ceiling fan according to the present invention.
Figure 2:
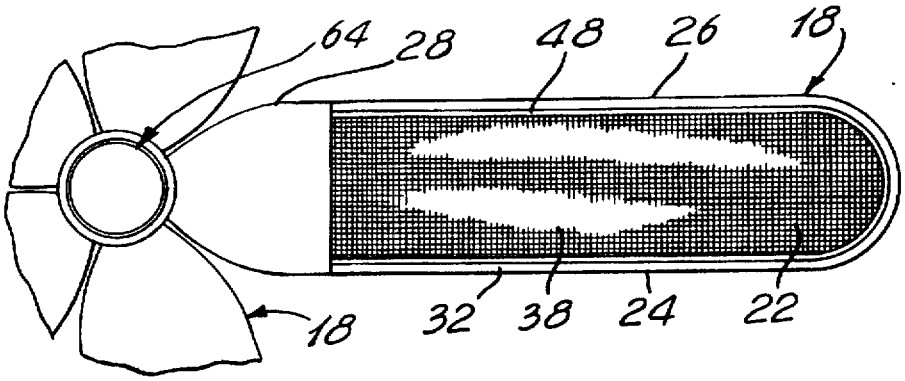
FIG. 2 is a bottom plan view of a detail of the ceiling fan shown in FIG. 1.
Figure 3:
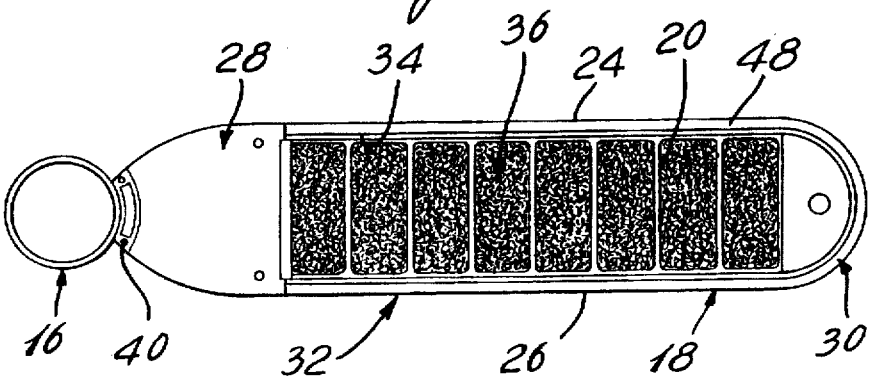
FIG. 3 is a top plan view of the detail shown in FIG. 2.

Referring now to FIGS. 1 to 6, a ceiling fan 10 is illustrated having a mounting shaft or frame 12, a motor housing 14 fixed to the frame 12, a rotatable hub 16, and five fan blades 18 extending radially from the hub 16. The ceiling fan 10 is for all respects a conventional ceiling fan design. However, each of the fan blades 18, in the illustrated embodiment, is provided with the filter device of the present invention.

As shown in FIGS. 2 through 6, each fan blade 18 includes a top surface 20 and a bottom surface 22, a side edge 24, and a side edge 26. The side edges 24 and 26 may be the leading or trailing edges respectively depending on the direction in which the fan 10 is made to rotate. The blade 18 has a root 28 and a tip 30 as well as a main fan blade body 32. Generally speaking, the fan blade 18, according to the embodiment shown in FIGS. 2 through 6, includes a cavity 34 which extends for the majority of the area of the body 32. A screen 38 extends about the bottom surface 22 covering the opening thereof and is also able to support the filter material.

The filter unit 36 is shown in the drawings as located within the cavity 34. The filter material may comprise a particulate filter and may also include a sorbent filter made of carbon, zeolite, etc., for adsorption of gases and odors. The particulate filter may be electrically charged.

Figures 4, 5, 6:
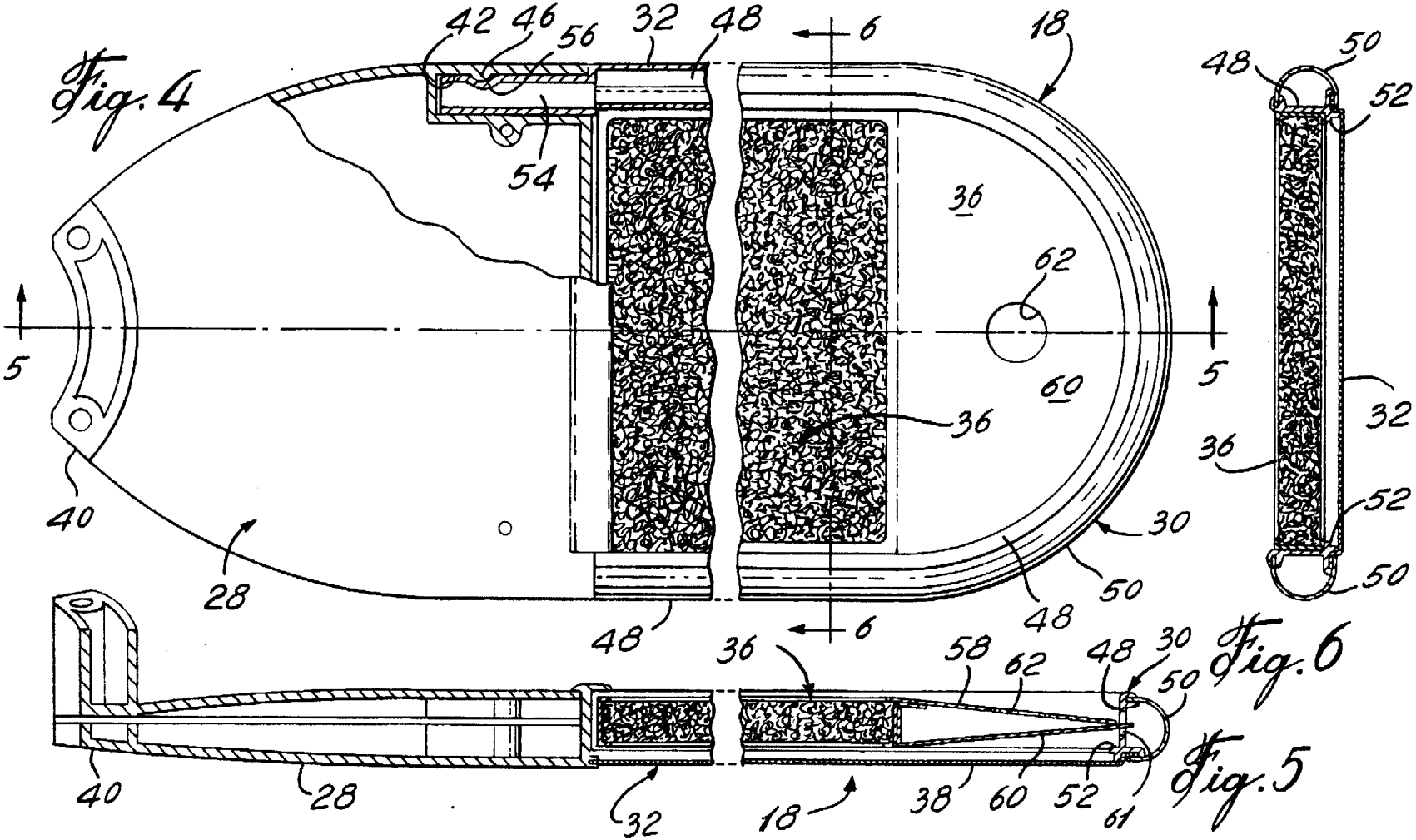
FIG. 4 is an enlarged fragmentary top plan view, partly in cross-section, of the fan blade shown in FIG. 3.
FIG. 5 is a vertical cross-section taken through line 5—5 of FIG. 4.
FIG. 6 is a vertical cross-section taken along line 6—6 of FIG. 4.
Figure 7:
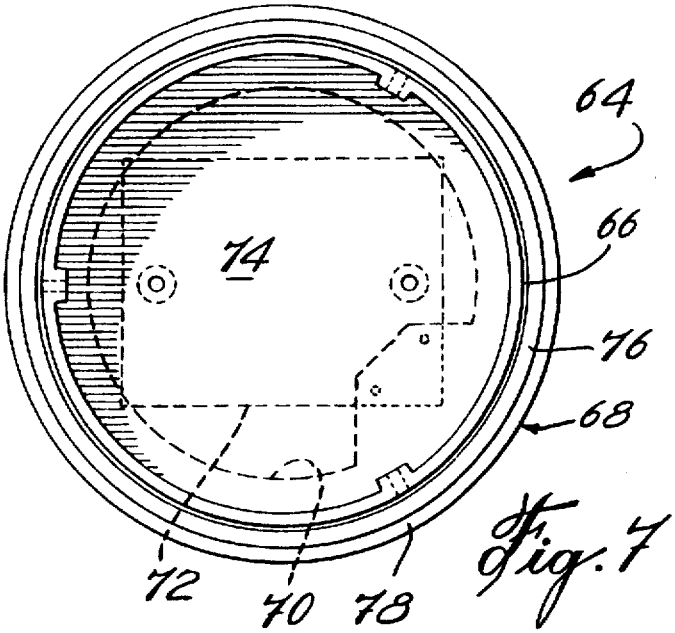
FIG. 7 is a top plan view of a further detail of the present invention as shown in FIG. 1.

The blade root 28, in the present embodiment, includes a mounting bracket 40 to be mounted to a rotating portion of the hub 16. As shown in the drawings, the root 28 is hollow and may be made from a pair of molded plastic halves. The root 28 defines a pair of sockets 42 (only one is shown in FIG. 4) to receive the replaceable body portion 32. A detent rib 46 is formed in the socket 42.

The body portion 32 includes an uninterrupted metal frame 50 which defines the periphery of the body portion 32 and the tip 30 as well as the cavity 34. A plastic extrusion 48 is snap fitted to the frame 50, as shown in FIGS. 4, 5, and 6. The extrusion 48 is formed with a ledge 52 to support the filter container 58, as will be described. The frame 50 includes a pair of legs 54 which are inserted into the sockets 42 of the root 28. The legs 54 include indents 56 which coincide with the detent ribs 46 when the legs 54 are inserted in the sockets 42.

The filter unit 36 may include filter material in a cardboard or disposable plastic container. In the present case, the filter container 58 is self-supporting, and when inserted in the cavity 34, the edges of the container 58 are supported on the continuous ledge 52 of the extrusion 48. The extension portion 60 of the container 58 covers the tip area of the cavity and may be engaged, as shown in FIG. 5, in a slot 61 provided in the extrusion 48. A finger opening 62 may also be provided in this extension area 60 for readily removing the container from the cavity.

The filter unit 36 may take different forms and may be merely a flexible package or several packages containing the particulate filter and/or sorbent material which is adapted to lie in the cavity 34 on the screen 32. The filter unit 36 need not be self-supporting but need only be dimensioned to fit within the cavity 34. The filter unit 36, according to the present invention, must be shaped to fit within the dimensional parameters of the blade 18 which has an outline in cross-section similar to conventional ceiling fan blades. In fact, the fan blade 18 of the present invention may be considered as a conventional fan blade with a cavity formed therein opening to both the top and bottom surfaces of the fan blade to allow air to pass therethrough when the fan is in operation.

The above construction is but an example of how a typical fan blade in accordance with the present invention might be constructed.

Figure 8:
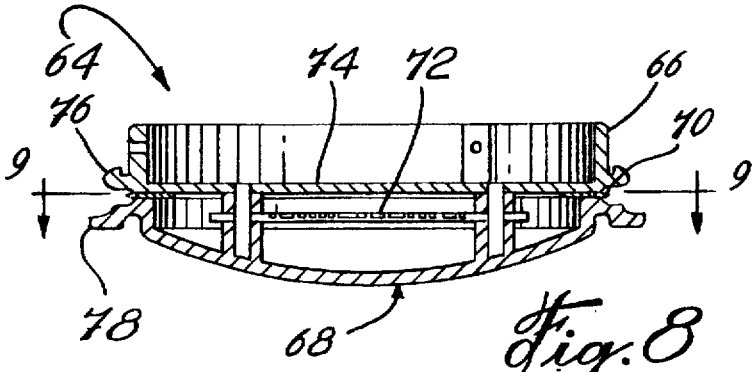
FIG. 8 is a vertical cross-section taken through the detail of FIG. 7.
Figure 9:
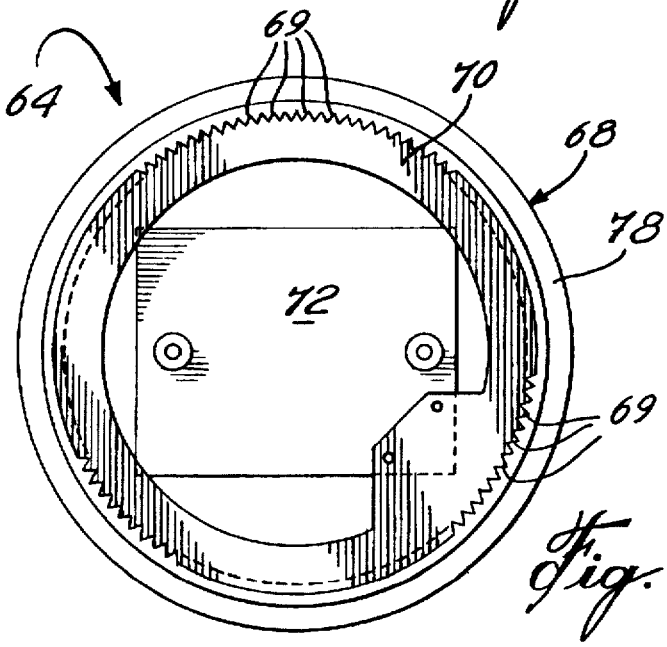
FIG. 9 is a horizontal cross-section taken along line 9—9 of FIG. 8.

Another aspect of the present invention includes an ion emitter 64 which is fixed to the frame 12. The ion emitter 64 includes a cylindrical housing 66 which is meant to smoothly match with the hub 16. A cap 68 may be fastened to the cylindrical housing 66 and sandwiches an ion emitting foil 70, as shown in FIGS. 8 and 9. The ion emitter foil 70 includes a peripheral serrated edge presenting sharp emitter points 69. The sharp points 69 replace the ion emitter needles typical in such emitters.

As shown in the drawings, the circuit board 72 connected to an electrical source and capable of generating voltages when connected to the emitter foil 70, is mounted in the cap 68, and the emitting foil 70 is held by the cap 68 against the wall 74 of the housing 64. The cylinder 66 has a peripheral lip 76 that, in combination with a similar lip 78 on the cap 68, defines a gap surrounding the points 69 in order to protect the points. For instance, the gap is not wide enough to allow a finger or most tools to be inserted.

The filter material may be in the form of an electret and, in combination with the ion emitter 64, will enhance the capturing of airborne particles which become charged when they enter the electrical field surrounding the fan 10.

As can be seen from the above, when the fan 10 is in operation, the fan blades 18 will rotate in a plane substantially perpendicular to the airflow caused by the fan 10. An area of relatively high pressure exists on the bottom surface 22 of the fan blades 18 (when the fan is rotating counterclockwise), and an area of relatively low pressure is formed on the upper surface 20 of the fan blades 18. Depending on the resistance to air flow provided by the filter units 36, considerable volumes of air will penetrate the filter through the bottom surface 22 of the fan blades 18, thereby causing the airborne particles in this volume of air to be trapped within the filter 36. Thus, the filter units 36 provide depth filtration as well as surface filtration for the airflow. Large diameter ceiling fans are capable of providing high volume airflows with low noise levels compared with self-contained air cleaners. The large blade surface facilitates the incorporation of significant surface areas of filtration without restricting airflow while the pressure distribution around the blade during operation facilitates the depth filtration.

The particular construction of the fan blades allows a variety of high quality particulate and sorbent filters to be used without concern for their structural properties, that is, the filter units need not be self-supporting.

We claim:

1. A fan, comprising: a plurality of radially extending fan blades, wherein at least one fan blade comprises a first surface and a parallel second surface defined by a peripheral edge including side edge segments, the at least one fan blade including at least a cavity open to the first and second surfaces; the at least one fan blade also including a frame defining the at least one cavity, the frame defining a seat comprising a porous support structure covering the at least one cavity, at least one filter unit adapted to be seated in the at least one cavity and supported by the porous support structure such that, as the fan is operated, the at least one filter unit will be in a substantially perpendicular plane to a direction of airflow created by the fan for filtering airborne particles from the airflow.

2. The fan as defined in claim 1, wherein the fan is a ceiling fan.

3. The ceiling fan as defined in claim 2, wherein the first surface of the at least one fan blade is a bottom surface thereof relative to the ceiling fan and the porous support structure covers the at least one cavity with the bottom surface and the porous support structure being substantially co-planar.

4. The ceiling fan as defined in claim 3, wherein the porous support structure is a structural grid in the form of a screen mounted to the frame.

5. The ceiling fan as defined in claim 2, wherein the at least one cavity extends for the major area of the at least one fan blade and the frame is coincident with the side edge segments, and the at least one filter unit extends throughout the at least one cavity and is co-extensive with the first and second surfaces.

6. The ceiling fan as defined in claim 2, wherein the fan includes a rotating hub, and the fan blades are mounted to the rotating hub, and each fan blade has a root portion with a mounting bracket for mounting to the rotating hub, a fan blade body replaceably connected to the root portion of the fan blade, and the fan blade body of the at least one fan blade including the frame defining the at least one cavity.

7. The ceiling fan as defined in claim 6, wherein the blade body of the at least one fan blade includes the blade tip, and the at least one cavity is defined by the frame which is coincident with the side edge segments and the periphery of the blade tip, and the first surface of the at least one blade is the bottom of the at least one blade with the porous support structure substantially at the level of the bottom.

8. The ceiling fan as defined in claim 6, wherein the root portions of the respective fan blades and the respective fan blade bodies include respective complementary male and female connecting members.

9. The fan as defined in claim 1, wherein there are a plurality of fan blades and each fan blade has at least one cavity open to the first and second surfaces of each blade and adapted to receive at least one filter unit in each of the fan blades.

10. The fan as defined in claim 1, wherein the at least one filter unit, when seated in the at least one cavity, is within cross-sectional parameters of the at least one fan blade.

11. A fan, comprising: a plurality of radially extending fan blades, wherein at least one fan blade comprises a first surface and a parallel second surface defined by a peripheral edge including side edge segments, the at least one fan blade including at least a cavity open to the first and second surfaces, and at least one filter unit adapted to be seated in the at least one cavity such that, as the fan is operated, the at least one filter unit will be in a substantially perpendicular plane to a direction of airflow created by the fan for filtering airborne particles from the airflow, and wherein the fan includes a fixed frame, an ion emitter mounted to the fixed frame, whereby airborne particles that become charged passing through an electrically charged field created by the ion emitter on the frame of the fan will be attracted to the at least one filter unit in the at least one fan blade.

12. The fan as defined in claim 11, wherein the ion emitter includes a body portion fixed to the fixed frame and a cap portion defining an annular ion emitting zone, and an annular ion emitter foil having a peripheral series of sharp points sandwiched between the cap portion and the body portion in the ion emitting zone for emitting said ions.

13. A method of air cleaning with a fan including fan blades having first and second parallel surfaces, comprising the steps of:

(a) forming cavities in at least some fan blades of the fan, wherein said cavities are open to the first and second surfaces of each of the some fan blades;

(b) placing a filter unit in each cavity;

(c) supporting the filter unit in the cavity by placing a porous support member to cover the cavity at the first surface; and (d) rotating the fan so that the fan blades define a rotating plane substantially perpendicular to an airflow forced by the fan, and whereby a high pressure zone is created on the first surface of the fan blades and a corresponding low pressure on the second surface thereof such that air will be forced through the filters in the cavities of the some fan blades from the first surface through to the second surface of each of the some fan blades containing the filters.

14. An ion emitter including a housing and a cap connected to the housing to define an ion emitting zone in a room and an ion emitting foil having a serrated annular edge providing a series of sharp points suitable for emitting ions generated in the ion emitter such that an electrical field can be formed in an open area around said ion emitter, and wherein the cap and housing each have a projecting lip defining a gap defining the ion emitting zone, and the gap having an opening small enough to prevent human fingers from being inserted in the gap and touching the serrated edge of the foil in the so-formed gap.

15. A fan, comprising: a plurality of radially extending fan blades, wherein at least one fan blade comprises a first surface and a parallel second surface defined by a peripheral edge including side edge segments, the blade including at least a cavity open to the first and second surfaces, at least one filter unit adapted to be seated in the cavity such that, as the fan is operated, the at least one filter unit will be in a substantially perpendicular plane to a direction of an airflow created by the fan, for filtering airborne particles from the airflow, and wherein the fan includes a fixed frame, and an ion emitter mounted to the fixed frame, whereby airborne particles that become charged passing through an electrically charged field created by the ion emitter on the fixed frame of the fan will be attracted to the fan blades.

16. The fan as defined in claim 15, wherein the at least one filter unit includes electrets and the electrically charged airborne particles will be attracted to the electrets in the at least one filter unit of the at least one fan blade.

17. The fan as defined in claim 15, wherein the ion emitter includes a body portion fixed to the fixed frame and a cap portion defining an annular ion emitting zone, and an annular ion emitter foil having a peripheral series of sharp points sandwiched between the cap portion and the body portion in the ion emitting zone for emitting said ions.

18. A filter unit for use in a cavity of a fan blade of a fan, the fan blade having a root, tip and side edges and the cavity extending for the full extent of the blade with cavity margins being defined by the root portion of the blade, the tip portion of the blade, and side frame members, the filter unit including a disposable container and filter material within the container, the container including side portions adapted to cooperate with the side frame members of the fan blade, the container further including a root end portion and a tip end portion, the tip end portion having an extension tapering to a narrow edge and the tip portion of the blade including a slot for receiving the narrow edge of the tip extension of the container.

* * * * *